United States Patent [19]

Kaiser et al.

[11] 4,055,289

[45] Oct. 25, 1977

[54] PHOTOGRAPHIC APPARATUS

[75] Inventors: Michael Kaiser, Germering; Ludwig Schäffer, Munich, both of Germany

[73] Assignee: Agfa-Gevaert Aktiengesellschaft, Leverkusen, Germany

[21] Appl. No.: 666,005

[22] Filed: Mar. 11, 1976

[30] Foreign Application Priority Data

Mar. 22, 1975 Germany ..... 2512826

[51] Int. Cl.[2] ..... B65H 17/34

[52] U.S. Cl. ..... 226/92; 214/1.7; 226/88; 226/200; 354/340

[58] Field of Search ..... 226/92, 91, 88, 1, 12, 226/200; 352/235, 228, 157, 158; 354/321, 340, 345; 214/1.7; 242/195

[56] References Cited

U.S. PATENT DOCUMENTS

| | | | |
|---|---|---|---|
| 2,878,924 | 3/1959 | Dye et al. | 354/321 X |
| 3,713,649 | 1/1973 | Van Kempen et al. | 226/92 X |
| 3,810,568 | 5/1974 | Kwiaikowski et al. | 226/92 |

*Primary Examiner*—Bruce H. Stoner, Jr.
*Attorney, Agent, or Firm*—Michael J. Striker

[57] ABSTRACT

A photographic apparatus in which strip-shaped material is to be advanced by means of a travelling leader tape, has a carrier for the strip-shaped material, the carrier being formed with a channel. An arrangement is provided by means of which the leader tape can be sprung into the channel in response to a command signal so that a mechanical connection becomes established between the leader tape and the carrier and the latter is taken along by the travelling leader tape.

14 Claims, 7 Drawing Figures

PHOTOGRAPHIC APPARATUS

BACKGROUND OF THE INVENTION

The present invention relates to a photographic apparatus in general, and in particular to a photographic apparatus of the type wherein a strip-shaped material is to be advanced by means of a travelling leader tape.

In many instances it is necessary to advance photographic material, usually in strip-shaped form, through all or part of a photographic apparatus. In some cases it is necessary for this purpose to employ a travelling leader tape. This is done if the leading end of a strip of material is to enter the apparatus or a part thereof through an inlet which is constructed to prevent access of light to the interior, or if there is simply no way in which the leading end of the strip-shaped material can be manually inserted into the apparatus or the particular part thereof. Leader tapes are, accordingly, widely — but not exclusively — used for pulling strip-shaped photographic material through a series of baths in a developing apparatus.

In a apparatus in which leader tapes are employed, it is customary to provide a carrier for the strip-shaped material on or to which the material can be secured. Such carriers are formed with a channel that is defined by two transversely spaced U-shaped hook-shaped configurations which are transversely spaced from one another by a distance slightly smaller than the width of the leader tape. The leader tape is manually inserted into the channel so that upon insertion it becomes slightly bowed and sprung in the channel, i.e. in its tendency to flatten out — the tape is usually of synthetic plastic material — it presses against the surfaces bounding the channel and thus establishes a mechanical connection with the carrier, taking the latter along. In the older type of apparatus using this leader tape approach, the just-described arrangement has been generally satisfactory. Not so, however, in the more modern types of apparatus wherein the strip-shaped material is to be transported at speeds which are usually in excess of 8 meters per minute and at the present time and stage of development may be as high as 15 meters per minute. This means, of course, that the leader tape must travel at a corresponding speed and, this in turn, clearly precludes any possibility of establishing a manual connection between the carriers and the travelling leader tape. While it has been proposed to provide such an apparatus with a storage reservoir for the leader tape, making it possible to actually stop the leader tape at a certain point outside the apparatus in order to permit the respective carriers to be connected to it, it has been found that a storage reservoir capable of storing efficient of the leader tape so that the portion located outside the apparatus can be temporarily halted, is so voluminous and structurally complicated and therefore expensive, as to make this solution impractical for commerically utilizable equipment.

SUMMARY OF THE INVENTION

Accordingly, it is an object of the present invention to provide an improved photographic apparatus which is not possessed of the above-outlined disadvantages.

More particularly, it is an object of the invention to provide an improved photographic apparatus of the type herein under discussion which avoids the disadvantages of the prior art.

Still more particularly, it is an object of the present invention to provide such an improved photographic apparatus wherein the carriers for the strip-shaped material can be mechanically connected to the travelling leader tape and do not require manual connection.

In keeping with these objects, and with others which will become apparent hereafter, one feature of the invention resides in a photographic apparatus particularly but not exclusively a developing apparatus, of the type wherein strip-shaped material is advanced by means of a travelling leader tape. According to the invention, the apparatus includes a combination of a carrier for the strip-shaped material, the carrier being formed with a channel, and means for springing the leader tape into the channel in response to a command signal.

Thus, the apparatus of the invention makes it possible to mechanically connect the respective carriers to the leader tape without having to stop or slow-down the leader tape and without having to resort to any kind of manual manipulation at all.

This is in contradistinction to the allowed German application No. 1,154,040 which teaches an arrangement wherein a carrier that is already connected to a leader tape can be mechanically disconnected from the same after travelling through the apparatus. The device taught in that application is suitable exclusively for disconnecting purposes and cannot be used for connecting a carrier mechanically to a travelling leader tape.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
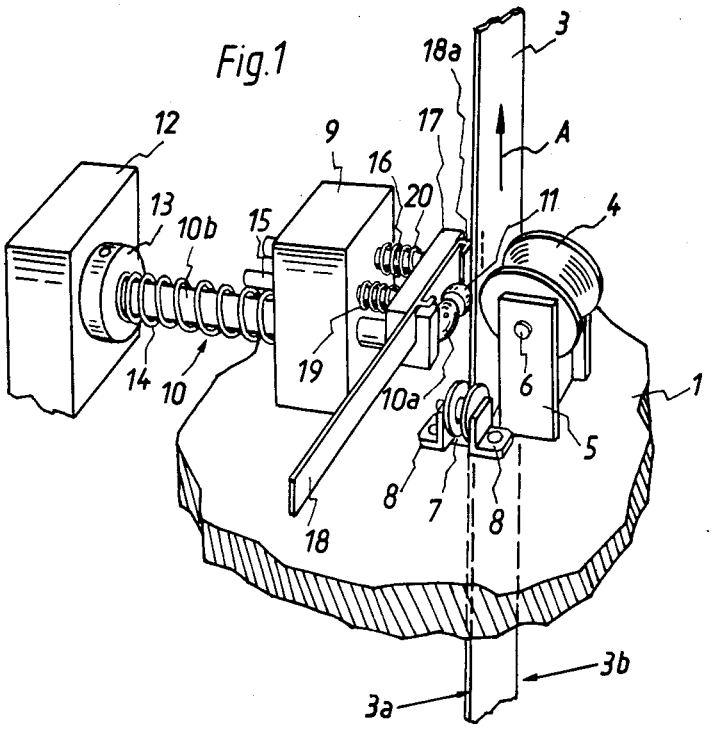
FIG. 1 is a somewhat diagrammatic partially sectioned perspective view of those components of a photographic apparatus embodying the invention which are essential for the understanding of the invention.
Figure 3:
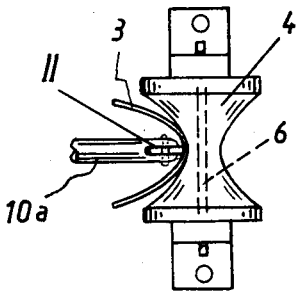
FIG. 3 is a top-plan view of a detail of the apparatus in FIG. 1, shown in the operative position of FIG. 2*b;*

A first embodiment of the invention is illustrated in FIGS. 1–3. It is to be understood that only those portions of a photographic apparatus embodying the invention are illustrated which are needed for a proper understanding of the invention. All other elements which are not shown and described should be understood as being well known per se to those having skill in the art.

Figure 2A:
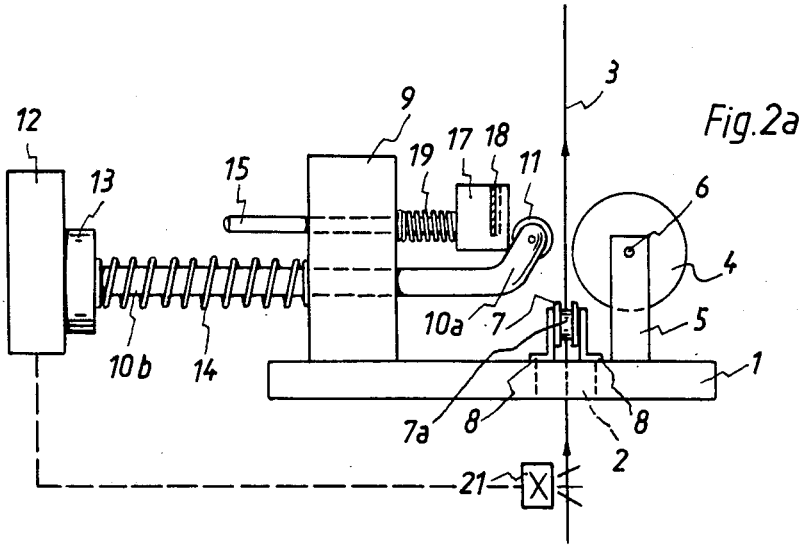
FIG. 2*a* is a diagrammatic side view of the apparatus in FIG. 1, showing the apparatus in rest position.
Figure 2B:
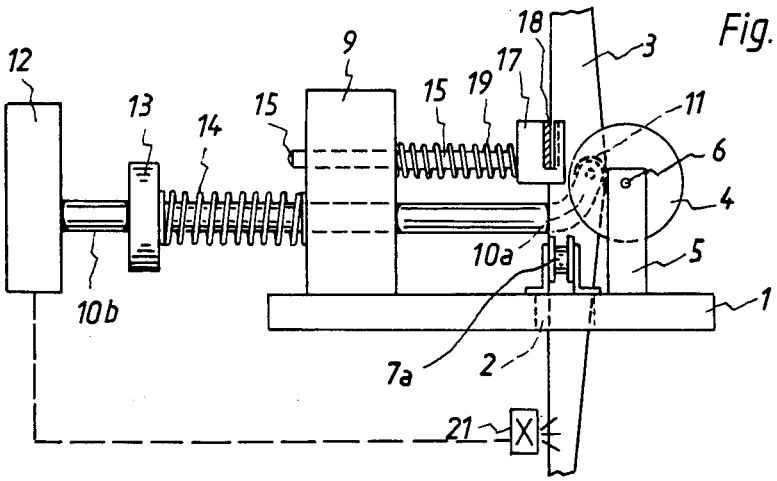
FIG. 2*b* is a view similar to FIG. 2*a* but showing the apparatus in an operative position.

With the above in mind it will be seen that reference numeral 1 identifies in FIGS. 1, 2*a* and 2*b* a support or base plate on which the components of a device for automatically connecting a carrier to a travelling leader tape 3 are mounted. The base plate 1 is provided with a cutout or aperture 2 (see FIGS. 2*a* and 2*b*) through which the leader tape 3 — which may be of synthetic plastic material as is known in the art — travels in the direction indicated by the arrow A in FIG. 1. The dimensions of the aperture 2 are so chosen that the leader tape 3 will travel through the aperture 2 under all circumstances without contacting the sides of the aperture, i.e. either in the flat unbowed condition of FIGS. 1 and 2*a* or in the bowed condition of FIG. 2*b* the tape 3 would travel through the aperture 2 without contacting the sides thereof.

The leader tape 3 has two opposite major surfaces one of which is visible in FIG. 1; it also has two opposite lateral edges 3*a* and 3*b*. Adjacent one of the major surfaces of the leader tape 3, in FIG. 1 the major surface that is visible, there is provided a roller 4 which is mounted in a journal 5 for rotation about an axis 6 extending parallel to the major surface of the leader tape when the latter is in the flat, unbowed condition shown in FIG. 1. The journal is, of course, fixedly mounted on the plate 1. The axis of rotation 6 extends at right angle to the direction of movement A of the leader tape 3 and the spacing between the roller 4 and the leader tape 3 is so selected that in the non-operated condition of the arrangement the leader tape is just out of contact with the periphery of the roller 4.

As FIG. 3 shows most clearly, the periphery of the roller 4 is arcuately recessed and more particularly the roller 4 is so shaped that in an axial view or section it is configured essentially as a hyperbolic body of rotation. FIG. 1 shows clearly that the axial length of the roller 4 is approximately equal to the transverse width of the leader tape 3 when the same is in flat condition; preferably the axial length of the roller 4 is somewhat smaller than the transverse width of the leader tape 3.

Also mounted on the plate 1 are two edge guiding rollers 7 (only one visible) each of which is mounted for rotation in a journal 8 that is secured on the plate 1. Each of the edge guiding rollers 7 is provided in its periphery with a circumferential groove or recess 7*a* (see FIG. 2*a*) through which a respective edge 3*a* or 3*b* of the leader tape 3 travels. The purpose of the rollers 7 is, of course, to guide the edges of the leader tape 3 and to prevent the latter from shifting out of its assigned orientation and position.

Also mounted on the plate 1, but adjacent the opposite major surface of the leader tape 3, the one which is not visible in FIG. 1, is provided an arrangement which serves to deflect the leader tape 3, or more particularly to cause it to bow. This arrangement includes a mounting block or member 9 which is secured on the plate 1 and provided with bores. A pressure rod 10 is slidably received in one of these bores so as to project beyond the opposite sides of the block 9. A portion 10*a* of the pressure rod 10 (best seen in FIG. 2*a*) extends first straight out of the block 9 and then has its free end bent upwardly at an angle and carries a pressure roll 11 which is freely rotatably mounted on this end. The axis of rotation of the pressure roller 11 is thus located approximately at the same level as the axis of rotation 6 of the roller 4 and extends parallel to that axis 6. Another portion 10*b* of the rod 10 projects from the opposite side of the block 9 and is connected with a drive 12 which serves to shift the rod 10 horizontally in direction towards the roller 4 and the axis of rotation 6 thereof. An abutment 13 is provided on the drive 12 and a biasing spring 14 surrounds the portion 10*b* of the rod 10, bearing with its opposite ends against the abutment 13 and the block 9, respectively, so that the spring 14 urges the rod 10 permanently towards the left in FIG. 2*a* when the drive 12 is not operated. The position in FIG. 2*a* is, therefore, the non-operated or rest position of the arrangement.

Also received in bores of the block 9 are two guide rods 15 and 16 which are transversely spaced and which can be shifted parallel to the rod 10. The end portion of the rods 15 and 16 which project to the right from the block 9, i.e. which project towards the roller 4, have mounted on them a receiver 17 which is provided with a recess that is open in the same direction in which the leader tape 3 travels, i.e. in upward direction in FIGS. 2*a* and 2*b*. Insertable into this recess of the receiver 17 are respective carriers 18 (one shown) for the strip-shaped material to be transported by the leader tape 3. The configuration of the carrier 18 is known from the art, involving a main portion which is accommodatable in the recess of the receiver 17 and a projecting arm (see FIG. 1) that extends laterally outwardly of the receiver 17 and to which the material to be transported can be secured, for example by wrapping an end of the material around the projecting arm. The recess in the receiver 17 is so configurated that the carrier 18 can be inserted into it with the projecting arm either projecting to one side (i.e. out of the plane of FIG. 1 and towards the viewer) or to the other side (again out of the plane of FIG. 1, but away from the viewer). It is of major importance that the recess in the receiver 17 be so shaped that the insertion of the carrier 18 can take place only opposite to the direction of movement A of the leader tape, so that upon subsequent mechanical connection between the leader tape and the carrier 18 the latter will be lifted out of the recess in the receiver 17 by the leader tape and taken along. That portion of the carrier 18 which is received in the recess of the receiver 17 is provided with two transversely spaced parallel substantially hook-shaped (i.e. substantially U-cross-sectioned) portions 18*a* which form between themselves a channel into which the leader tape 3 is subsequently to be sprung. The portions of the rod 15 and 16 which project to the right past the block 9 are surrounded by helical springs 19 and 20, respectively, which bear with their opposite ends against the block 9 and the receiver 17, respectively. Thus, the springs 19 and 20 permanently urge the receiver 17 and of course the rods 15, 16 towards the right in FIG. 2*a*, i.e. towards the roller 4. However, because the end portion of the part 10*a* of the rod 10 is bent upwardly, this end portion is in the way of the receiver 17, constituting an abutment for the same so that the receiver 17 can be urged only against this abutment; the springs 19, 20 cannot urge the receiver 17 against the abutment formed by the bent-up part of the portion 10*a* of the rod 10 because their combined force is less than the force of the spring 14 which acts upon the rod 10 in the opposite direction to the springs 19 and 20. This, incidentally, has the additional advantage that the end portions of the rods 15 and 16 which project past the block 9 on the left-hand side need not be secured against being pulled through the block 9 towards the right-hand side thereof, since the maximum path of movement of the rod 10 determines the maximum path of movement possible for the rods 15, 16 and the receiver 17 and since the rods 15 and 16 are of a length sufficient to assure that their left-ends cannot slip out of the passages in the block 9 even when the rods 15, 16 move through the maximum distance towards the right in FIG. 1.

As previously indicated, FIG. 2*a* shows the arrangement in its rest position in which the leader tape 3 travels freely through the aperture 2, being guided only at its edge portions 3*a* and 3*b* by the respective guide rollers 7 (one shown). The rod 10 is maintained in its left-hand end (i.e. rest) position by the force of the spring 14 and the free end of its portion 10*a* abuts the receiver 17 and maintains the same also in the left-hand rest position thereof in which the springs 19 and 20 surrounding the rods 15, 16, respectively, are axially compressed.

If it is now desired to insert strip-shaped material into the photographic apparatus of which the illustrated arrangement is a part, then a portion of the material is secured to the projecting arm of a carrier 18, for example by being wound around this arm repeatedly. The connection can, of course, also be established in other ways. Thereupon, the main portion of the carrier 18 is inserted into the recess in the receiver 17, so that the carrier 18 is now positioned as shown in FIG. 1 (or else with its free arm 18 projecting to the opposite side from the one shown in FIG. 1). To which side the free arm of the carrier 18 is to project depends upon the particular photographic apparatus provided with the novel device and the manner in which the leader tape 3 is guided. For purposes of the present invention it is immaterial to which side the free arm of the carrier 18 projects. The carrier 18 having once been inserted in this manner, a signal can now be given in any conventional manner to the drive 12 which may produce electrically, magnetically, pneumatically, or mechanically a force serving to shift the rod 10 towards the right from the position of FIG. 2*a* to the position of FIG. 2*b*, i.e. towards the roller 4. This causes the press roll 11 to push against the left-hand major surface of the leader tape 3, substantially midway the edges 3*a* and 3*b* thereof, and to deform or bow the leader tape 3 to the configuration shown in FIG. 2*b* and most clearly visible in FIG. 3. Thus, the tape 3 moves essentially into conformance with the contour of the hyperbolic concavity in the periphery of the roller 4. Since the roller 4 and the press roll 11 are both freely turnably journalled, the leader tape 3 can continue to travel in the direction of the arrow A even in this deformed condition, without being subjected to any perceptible braking action. The deformation or bowing of course results in the edges 3*a* and 3*b* of the leader tape 3 approaching one another so that their spacing from one another is now smaller than the spacing between the hooks 18*a* of the carrier 18. The leader tape 3 is therefore now ready to enter into the channel defined in the carrier 18 by the presence of the hooks 18*a*.

This insertion comes about as a result of the fact that the right-hand movement of the rod 10 simultaneously permits right-hand movement of the receiver 17 with the rods 15 and 16. The expanding springs 19 and 20 cause the receiver 17 to move towards the right as soon as the abutment in form of the upwardly bent part of the portion 10*a* of the rod 10 recedes from it in the same direction, and this movement of the receiver 17 continues until the edges 3 and 3*b* of the leader tape 3 are lodged in the channel defined in the carrier 18 by the hooks 18*a* thereof.

It will be appreciated that the press roll 11 can move towards the right until it reaches the smallest diameter of the roller 4 (compare FIG. 3) whereas the receiver 17 will already be stopped in its rightward movement by contact of the edges 3*a* and 3*b* with the leader tape 3 with the carrier 18 and with the axial end portions of the roller 4. This means that the rod 10 performs a stroke the length of which is somewhat greater than the length of the stroke performed by the receiver 17, a fact which is of importance in terms of the reversal of motions which begins as soon as the edges 3*a* and 3*b* of the leader tape 3 are received in the channel of the carrier 18.

As soon as this has taken place, the drive 12 is deactivated and the above-described motions of the various components now become reversed, i.e. the components return from the position of FIG. 2*b* to the position of FIG. 2*a*. This reversal begins with the left-hand movement of the rod 10 under the influence of the biasing spring 14 as a result of which the bowing of the leader tape 3 is partially reversed, i.e. the leader tape 3 begins to move back towards (but not all the way to) its flat condition. This tendency to return to flat condition causes the edges 3*a* and 3*b* to move apart from one another and as the tape 3 is flexible, to engage behind the hooks 18*a*. Further reduction of the bowing of the leader tape 3 causes the edges 3*a* and 3*b* to move still farther apart and to become securely sprung in the channel of the carrier 18 behind the hooks 18*a* thereof.

This further reduction in the bowing of the tape 3 comes about as a result of the final movement of the rod 10 to its left-hand end or rest position. This final movement causes the abutment portion of the part 10*a* of the rod 10 to engage the receiver 17 and to shift it and the rods 15, 16 towards the left, thereby again compressing the springs 19, 20. Before the receiver 17 returns completely to its rest position shown in FIG. 2*a*, and as soon as the leader tape 3 has flattened out sufficiently so as to be securely sprung in the channel of the carrier 18 and thus securely mechanically connected with the carrier 18, the carrier 18 is lifted out of the recess of the receiver 17 by the continuously travelling leader tape 3 and is now taken along with the same, in turn taking along the strip-shaped material which is secured to the projecting arm of the carrier 18.

The connection between a carrier 18 and the leader tape 3 can be established very rapidly, inasmuch as the time required for the rod 10 to move first to the right and then to return back to the left to its rest position as shown in FIGS. 1 and 2*a*, amounts to only about 1 second. It is now no longer necessary to carry out any mechanical operations, other than to insert the carrier 18 into the recess of the receiver 17. Once this has taken place, and the command for operation of the drive 12 has been given, the carrier 18 will be connected to the travelling leader tape 3 within a time period of 1 second or less, and will be driven along by the leader tape 3.

It may be advantageous to provide ahead of the point of connecting of the carrier 18 to the leader tape 3 a detecting device 21. The term "ahead of" refers of course to the direction of travel A of the leader tape 3. The purpose of the detecting device 21 will be to detect whether an end connector of the leader tape — i.e. a connector which connects the opposite ends of the leader tape to make the same endless — is about to enter the novel arrangement. The purpose of such detection by the device 21, which is connected with the drive 12 as diagrammatically illustrated in FIGS. 2*a* and 2*b*, will be to prevent or to block operation of the drive 12 in the event a command has been given at about this time for the drive 12 to operate. This is necessary because it is not possible to secure a carrier 18 to such an end connector and because, if the end connector were bowed by the rod 10 in the manner shown for the leader tape 3 in FIG. 3, it would undergo permanent plastic deformation. The drive 12 may be a solenoid. The detector 21 can be performed by a light emitting source and a photoelectric cell which is suitable to disconnect the solenoid from its power source. However, the detector 21 can also be omitted.

Figure 4:
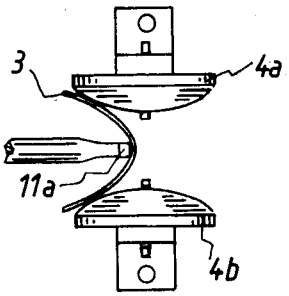
FIG. 4 is a view similar to FIG. 3, but illustrating a further embodiment of the invention.
Figure 5:
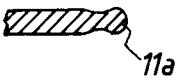
FIG. 5 is a fragmentary section through a part of the embodiment shown in FIG. 4.
Figure 6:
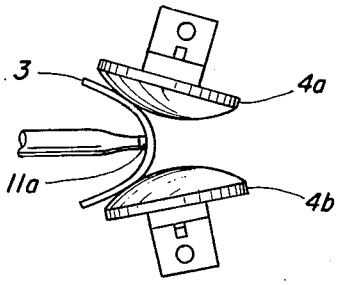
FIG. 6 is a view similar to FIG. 4, but showing a modified embodiment.

Various changes and modifications may be made in the illustrated device without in any way departing from the intended purpose of the invention. One possible further embodiment is illustrated by way of example in FIGS. 4 and 5. These Figures show that the roller 4 can be replaced with two separate rolls 4*a* and 4*b* having sides which face towards one another but are spaced from each other lengthwise of the axis of rotation which is again the axis 6 shown in FIG. 1. These facing sides of the rolls 4*a* and 4*b* are callotte-shaped as illustrated. The portion 10*a* of the rod 10 can be provided, instead of the press roll 11, with a slide piece 11*a* that may be of one-piece with the portion 10*a*, and have a smoothly polished surface, or perhaps a coating of low friction material, so that the piece 11*a* has only a low coefficient of friction relative to the leader tape 3. The piece 11*a* will then depress the leader tape 3 into the space between the callotte-shaped sides of the rolls 4*a* and 4*b*, as illustrated in FIG. 4, and will achieve substantially the same deformation as shown in FIG. 3. The axis of rotation of the rolls 4*a* and 4*b* may be coaxial as is shown in FIG. 4 or they may be inclined to form an angle with one another, as shown in the otherwise identical embodiment of FIG. 6.

Another modification that may be made is to mount the receiver 17 directly on the rod 10 movable relative to the same instead of mounting it on the guide rods 15, 16. Of course, the movement of the receiver 17 relative to the press roll 11 or the slide piece 11*a*, described earlier, must be taken into account in such a modification.

It will be understood that each of the elements described above, or two or more together, may also find a useful application in other types of constructions differing from the types described above.

While the invention has been illustrated and described as embodied in a photograhic apparatus, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a photographic apparatus, particularly a developing apparatus, a combination comprising a travelling leader tape having transversely spaced edges; a carrier to which material to be advanced by said leader tape is to be attached, said carrier being formed with a channel; first means for holding said carrier in position proximal to said leader tape; and second means for causing said leader tape to become lodged in said channel in sprung condition, so that the leader tape engages and entrains said carrier, said second means comprising deforming means for deforming said leader tape transversely of its direction of travel so that said edges become spaced from one another by a distance smaller than the width of said channel, effecting entry of said leader tape into said channel, and thereupon terminating said deflection so that said leader tape becomes sprung in said channel and said carrier thus becomes connected to said leader tape for travel with the same, said deforming means including roller means mounted adjacent one major surface of said leader tape for free rotation about a fixed axis, and a presser element mounted adjacent the opposite major surface of said leader tape for movement towards said roller means so as to press said leader tape towards said axis of said roller means.

2. A combination as defined in claim 1, wherein said presser element comprises a leader tape-engaging press roll.

3. A combination as defined in claim 1, wherein said roller means comprises a roller having a periphery which is concavely recessed, said roller being of hyperbolic longitudinal sectional configuration.

4. A combination as defined in claim 1, wherein said roller means comprises two rollers which are both rotated about said axis and spaced from one another lengthwise of the same so as to define a space between themselves, said presser element being adapted to press said leader tape inwardly of said space.

5. A combination as defined in claim 4, wherein said presser element has a free, leader tape-engaging end portion.

6. A combination as defined in claim 4, wherein each of said rollers has a calotte-shaped end facing the respective other roller, said rollers being oriented parallel to one another.

7. A combination as defined in claim 4, wherein each of said rollers has a calotte-shaped end facing the respective other roller, said rollers being oriented to include an angle with one another.

8. A combination as defined in claim 1, wherein said presser element comprises a rod having an end portion adapted for engagement with the leader tape, a drive for shifting said rod towards said leader tape, and biasing means permanently tending to bias said rod away from said leader tape.

9. A combination as defined in claim 8, wherein said first means includes a support member formed with a recess into which said carrier is insertable in direction opposite to the direction of travel of said leader tape.

10. A combination as defined in claim 9; further comprising biasing elements permanently tending to bias said support member towards said roller means, and an abutment portion on said rod which prevents movement of said support member towards said roller means until said drive operates to shift said rod.

11. A combination as defined in claim 10; said rod having a lower main portion, and said abutment portion extending upwardly from said main portion between said support member and said leader tape.

12. A combination as defined in claim 11, and mounting means for said support member and said rod and mounting the latter for travel over a distance greater than the travel of said support member.

13. In a photographic apparatus, particularly a developing apparatus, a combination comprising a travelling leader tape; a carrier to which material to be advanced by said leader tape is to be attached, said carrier being formed with a channel; first means for holding said carrier in position proximal to said leader tape; second means for causing said leader tape to become lodged in said channel in sprung condition, so that the leader tape engages and entrains said carrier, and detecting means arranged adjacent said leader tape upstream of said position of said carrier, as considered in the direction of travel of the tape, for detecting the approach of a tape-end connector and, in response to such detecting, for generating a signal to prevent operation of said second means.

14. In a photographic apparatus, particularly a developing apparatus, a combination comprising a travelling leader tape having transversely spaced edges; a carrier to which material to be advanced by said leader tape is to be attached, said carrier being formed with a channel; first means for holding said carrier in position proximal to said leader tape; and second means for causing said leader tape to become lodged in said channel in sprung condition, so that the leader tape engages and entrains said carrier, said second means comprising deforming means including a deforming element mounted adjacent one major surface of said leader tape for deforming said leader tape transversely of its direction of travel so that said edges become spaced from one another by a distance smaller than the width of said channel, effecting entry of said leader tape into said channel, and thereupon terminating said deflection so that said leader tape becomes sprung in said channel and said carrier thus becomes connected to said leader tape for travel with the same, said deforming means further including a presser element mounted adjacent the opposite major surface of said leader tape for movement towards said deforming element so as to press said leader tape towards the same.

* * * * *